United States Patent [19]

Höger

[11] 4,039,045

[45] Aug. 2, 1977

[54] DEVICE FOR LOWERING OBJECTS AND PERSONS BY ROPES

[76] Inventor: Rudolf Höger, Hauptstrasse 20, 2061 Tonningstedt, Germany

[21] Appl. No.: 564,729

[22] Filed: Apr. 3, 1975

[30] Foreign Application Priority Data

Apr. 3, 1974 Germany ..... 115790

[51] Int. Cl.[2] ..... A62B 1/06

[52] U.S. Cl. ..... 182/5; 188/65.4

[58] Field of Search ..... 182/5, 6, 7, 3; 188/65.4, 65.5, 65.2

[56] References Cited

U.S. PATENT DOCUMENTS

| | | | |
|---|---|---|---|
| 129,410 | 7/1872 | Hobson | 182/6 |
| 896,241 | 8/1908 | Pike | 182/7 |
| 3,087,584 | 4/1963 | Jackson | 188/65.5 |

*Primary Examiner*—Reinaldo P. Machado
*Attorney, Agent, or Firm*—Walter Becker

[57] ABSTRACT

A rope-descent device for lowering objects and in particular persons by means of a rope and comprising frame-mounted rollers around which a rope is run in an S-shaped path, the friction resulting from rope-to-roller and rope to rope contact being such that the rope tension transmitted through the device is greatly reduced so that, when the device is supported from one end of the rope an object such as a person supported from the device may be lowered by feeding the other end of the rope, which is subject only to the reduced rope tension, through the device. Reversal of the rolls of the rope ends, enables the device to be re-used without re-reeling the rope.

7 Claims, 3 Drawing Figures

DEVICE FOR LOWERING OBJECTS AND PERSONS BY ROPES

The invention relates to a device conveniently referred to as a rope-descent device for lowering objects and in particular persons by means of a rope.

Devices for this kind, comprising a rope and a seat belt, and used for rescuing persons from dangerous situations, such as fires in buildings for example, are known per se, but they have the various disadvantages of being expensive, taking up a considerable amount of space, or being awkward to handle.

It is the purpose of the invention to provide a rope-descent device for use in rescues, which can be produced inexpensively and is simple to manipulate.

This object and other objects and advantages of the invention will appear more clearly from the following specification in connection with the accompanying drawing, in which.

Figure 2:
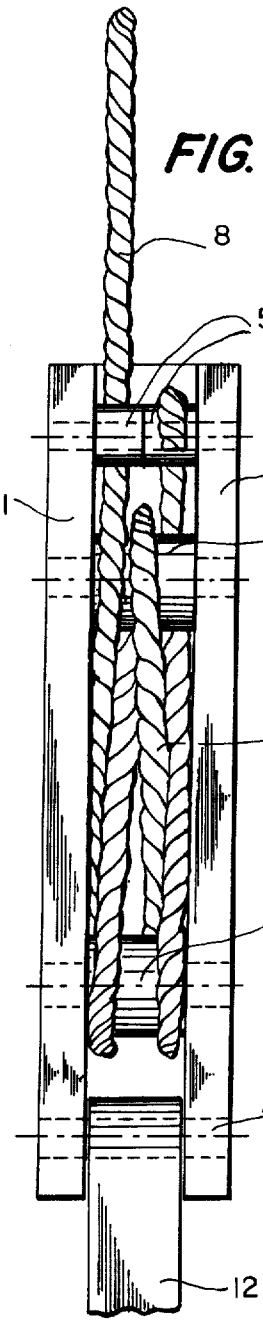
FIG. 2 is a side elevation of the rope-descent device according to FIG. 1.
Figure 3:
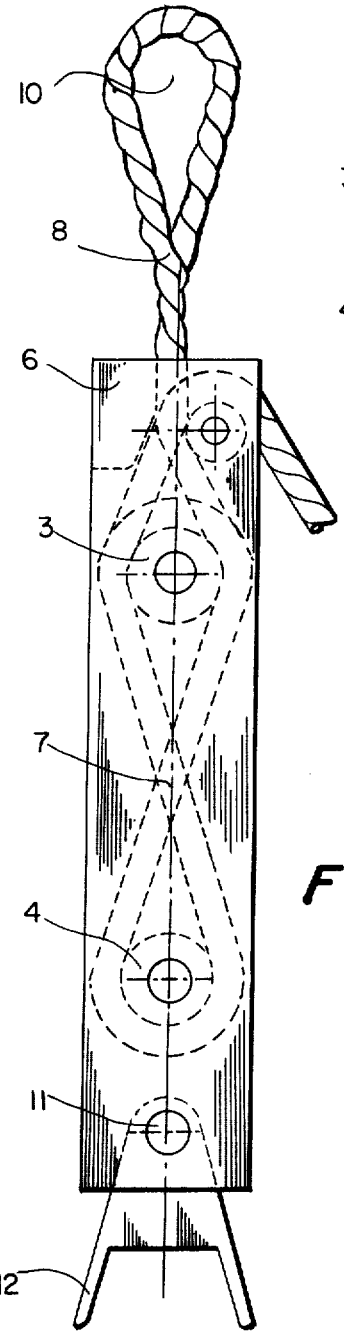
FIG. 3 is a front elevation of the rope-descent according to FIG. 2.
Figure 1:
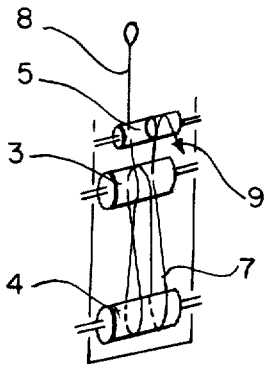
FIG. 1 is a diagrammatic representation of the course of the rope in a rope-descent device according to the invention.

According to the invention, a device for lowering objects and in particular persons by rope comprises a rope and a frame to support the object to be lowered and in which are mounted two main rollers or reels and a guide roller, the rope being led past the guide roller over the main rollers and passing at least twice around the main roller more remote from the guide roller.

A rope-descent device according to the invention may be produced compactly and economically out of two plates which constitute the frame in which the rollers are mounted. The frame and rollers need only be large enough to withstand the loads arising and the rollers need only have a surface curvature and spacing compatible with the possible radius of bending or curvature of the rope. The main bulk or volume of the device is therefore taken up by the rope, the length of which is determined by the lowering and rescue height desired. However, the overall dimensions of the device make it possible for it to be accommodated in a convenient container in any residence in a high-rise building or in any hotel room. In addition to being compactly storable in possible danger areas, the device is simple to manipulate, it being merely necessary, in the event of an emergency, to attach the shorter end of the rope projecting from the frame of the device to an anchorage in the building, such as a central-heating radiator, to seat oneself in a seat belt attached to the frame, and to lower oneself down the outside of the building, controlling the speed of descent by feeding the other end of the rope through the device under the action of the reduced rope tension transmitted through the device to bear the weight of the load being lowered. In order to make the device ready for use again, the frame is pulled back up with the end of the rope that was originally secured to the anchor, and the other end of the rope, which is now the shorter end projecting from the frame, is attached to the said anchorage. The device is now ready for use again without any rereeling.

In a practical construction of the device, the width of the frame is desirably such that the loops of rope running between the main rollers are pressed against each other. This increases the friction forces acting on the rope within the device and reduces still further the rope tension forces acting upon the free end of the rope during the lowering operation.

The seat belt is preferably secured to the end of the frame remote from a rope lead-in and lead-out which are located between the guide roller and a guide block mounted on the frame.

It has also been found advantageous to divide the guide roller, so that each half thereof can follow the movement of the loop of rope running thereon.

Alternatively the main and guide rollers may be in the form of stationary pins.

A particular embodiment of the invention is now described by way of example only with reference to the accompanying drawings.

Referring to the drawings, a rope-descent device comprises a frame consisting of plates 1 and 2 with aligned bores in which are mounted two main rollers or reels 3 and 4 and a guide roller 5. A guide block 6 is secured to the plates 1 and 2 facing guide roller 5, the guide roller and guide block defining a rope lead-in and lead-out. A rope 7, the ends 8, 9 of which both have a loop or eye 10, runs from the rope lead-in or lead-out over main rollers 3 and 4 in an S-shaped path, passing twice about main roller 4, which is the more remote from guide roller 5. The loops or sections of rope 7 extending between the main rollers 3 and 4 are pressed against each other by the plates 1 and 2 (which are spaced accordingly), whereby the rope is firmly held within the frame and the rope tension from one end to another is greatly reduced by virtue of the friction forces acting on the rope within the device. A seat belt 12, shown only in part, is secured to the end of the frame remote from the rope lead-in and lead-out, by means of a pin 11 arranged in bores in the plates 1 and 2.

The rope-descent device is manipulated as follows:

The eye 10 at the end 8 of the rope 7 is secured to an anchorage, not shown, and the person wishing to be lowered is seated in the seat belt 12 and grasps the end 9 of the rope 7. In order to control the speed of descent, the person lowering himself or herself allows the end 9 of the rope 7, which is subject only to small tension forces in relation to the weight carried by the device, to slide through his or her hand, or he or she may slacken it hand over hand. At the end of the descent, the eye, not shown, at end 9 of rope is close to the rope lead-in and lead-out. In order to make it possible to use the rope-descent device according to the invention again, without re-reeling, this eye must be secured to the anchorage in the building, instead of eye 10, whilst end 8 of rope 7 is paid out.

It is, of course, to be understood that the present invention is, by no means, limited to the specific showing in the drawing, but also comprises any modification within the scope of the appended claims.

What I claim is:

1. A device for lowering a person by rope, comprising the combination of a rope and a frame having means to support a person being lowered, said frame including a pair of spaced, vertical side plates, a pair of vertically spaced main rollers mounted in said side plates with their axes in a vertical plane passing through said side plates, guide means spaced above said main rollers, said guide means overlying said main rollers, said rope having a connection means for supporting said rope at its upper end, said rope extending past said guide means and at an angle to said vertical plane to the upper main roller, downwardly across said vertical plane to the lower main roller, around said lower main roller and upwardly across said vertical plane to said upper main roller, downwardly across said vertical plane and around said lower main roller a second time and upwardly across said vertical plane to said upper roller and at an angle to said guide to leave a free end beyond said frame for controlling movement of said rope around said rollers and through said frame, said plates being spaced apart such a distance as to press said rope together in crossing said vertical plane between said plates so that said rope resists movement through said frame and around said rollers.

2. A device for lowering objects and in particular to rescue persons by rope free of braking blocks and substantially free of heat being generated thereby, the device comprising in combination a rope and a frame to support the object to be lowered, and in which improvement therewith consists of there being mounted therewith in vertically spaced relationship to each other two main rollers and a guide roller having small diameter, the rope being led past said guide roller progressively over the main rollers in sequence and crossing the vertical plane of the axes of said main rollers, said frame having plates spaced from each other with the rollers being located within the frame in predetermined spaced relationship of said two main rollers and said guide roller to one side thereof, the rope passing at least twice around the main roller that is more remote from the guide roller, the width of the frame being such that the loops of the rope running between the main rollers and crossing said vertical plane are pressed against each other and said side plates.

3. A device in combination according to claim 1, in which a seat belt is secured to the end of the frame remote from the rope lead-in and lead-out.

4. A device in combination according to claim 1, in which a rope lead-in and lead-out are arranged between the guide roller and a guide block mounted on the frame.

5. A device in combination according to claim 4, in which the guide roller is divided to provide a separate lead-in and lead-out.

6. A device in combination to claim 1, in which the main rollers are in the form of stationary pins.

7. A device in combination to claim 1, in which said guide roller is in the form of a stationary pin.

* * * * *